United States Patent [19]

Miyamoto et al.

[11] Patent Number: 4,978,886

[45] Date of Patent: Dec. 18, 1990

[54] ELECTRON GUN FOR USE IN COLOR CATHODE RAY TUBE HAVING A PLURALITY OF GRID ELECTRODES

[75] Inventors: Satoru Miyamoto, Mobara; Yoshiaki Takahashi, Chiba; Katsuyuki Shirai, Mobara; Ikuya Takahara, Mobara; Satoru Endo, Mobara, all of Japan

[73] Assignees: Hitachi, Ltd.; Hitachi Device Engineering Co., Ltd., both of Chiba, Japan

[21] Appl. No.: 207,524

[22] Filed: Jun. 16, 1988

[30] Foreign Application Priority Data

Jun. 17, 1987 [JP] Japan ..... 62-149019

[51] Int. Cl.[5] ..... H01J 29/62; H01J 29/82

[52] U.S. Cl. ..... 313/414; 313/449; 313/458; 313/456

[58] Field of Search ..... 313/414, 449, 458, 460, 313/456, 482

[56] References Cited

U.S. PATENT DOCUMENTS

| | | | |
|---|---|---|---|
| 4,032,811 | 6/1977 | Schwartz et al. | 313/417 |
| 4,181,870 | 1/1980 | Stevens | 313/414 |
| 4,800,318 | 1/1989 | Naiki | 313/414 |

FOREIGN PATENT DOCUMENTS 59-215640 12/1984 Japan .

*Primary Examiner*—Kenneth Wider

*Attorney, Agent, or Firm*—Antonelli, Terry, Stout & Kraus

[57] ABSTRACT

At least one of grid electrodes which serves as a main lens of an electron gun for use in a color cathode ray tube is divided into a plurality of cylindrical electrodes coaxially connected. An inner electrode is provided at the connection part between the cylindrical electrodes so that the center of an elliptical aperture of the inner electrode coincides with the center of an inner wall of the grid electrode. Thus, astigmatism in the main lens is removed, thereby improving the resolution of the color cathode ray tube.

5 Claims, 7 Drawing Sheets

ELECTRON GUN FOR USE IN COLOR CATHODE RAY TUBE HAVING A PLURALITY OF GRID ELECTRODES

BACKGROUND OF THE INVENTION

This invention relates to an electron gun, particularly an in-line type electron gun, for use in a color cathode ray tube, and more particularly to an electrode structure that serves as a main lens of the in-line type electron gun.

One of the causes that influence the focus characteristic of a color cathode ray tube, e.g. a color picture tube is the diameter of the main lens of an electron gun in the tube. Desired focus characteristic can be obtained by using the main lens of as large diameter as possible.

However, it is very difficult to increase the main lens diameter in the in-line type electron gun. The reason is as follows. In the in-line type electron gun, three electron guns, corresponding to three colors of green, blue and red, arranged on a horizontal plane are integrated. Thus, if these three electron guns are incorporated in a neck tube with a limited diameter in the color cathode ray tube, the diameter of the cylinder that serves as the main lens of each electron gun and the interval between the main lens will be greatly restrained.

The above problem will be explained in more detail with reference to the drawings.

FIG. 1 is a sectional view of the color picture tube equipped with an in-line type electron gun of a conventional structure. FIG. 2 shows the detail of each grid electrode part in FIG. 1. In FIGS. 1 and 2, a phospher screen 3 with three color phosphors alternately applied thereon in the stripe shape is supported on the inner wall of a face plate 2 of a glass envelope 1. Central axes 15, 16 and 17 of cathode 6, 7 and 8 correspond to the central axes of their corresponding apertures of a first grid electrode 9 (referred to as $G_1$), a second grid electrode 10 (referred to as $G_2$), a third grid 11 (referred to as $G_3$) that is one electrode of an electrode pair constituting a main lens and a shield cup 13, and are arranged substantially parallel to each other on a common plane (The direction along this common plane is hereinafter referred to as a horizontal direction). A fourth grid electrode 12 (referred to as $G_4$ electrode) is the other electrode constituting the main lens. The central axis of a central aperture of the fourth grid electrode 12 corresponds to the central axis 16. On the other hand, as seen from FIG. 2, the center axes 18 and 19 of outer apertures of $G_4$ electrode do not correspond to the corresponding central axes 15 and 17 but are slightly outwardly deviated therefrom. More specifically, the diameter $L_1$ of the outer apertures of $G_3$ electrode 11 is smaller than the diameter $L_2$ of the outer apertures of $G_4$ electrode 12 ($L_1 < L_2$). Three electron beams emitted from the cathodes 6 to 8 are incident to the main lens consisting of $G_3$ electrode 11 and $G_4$ electrode 12 along the central axes 15, 16 and 17, respectively. Generally, $G_1$ electrode 9 is biased to 0 V and $G_2$ electrode 10 is 600 V to 800 V. $G_3$ electrode 11 is biased to 7 kV to 10 kV lower than $G_4$ electrode 12. $G_4$ electrode 12 is biased to the voltage as high as 25 kV to 30 kV. Shield cup 13 and the conductive film 5 provided on the inner wall of glass envelope 1 are also biased to the same high voltage. The central apertures of $G_3$ electrode 11 and $G_4$ electrode are coaxial so that the main lens is in axial symmetry at the central part. Thus, after the central beam is converged by the main lens, it travels straight on the line along the axis 16. On the other hand, the outside apertures of grid electrodes 11 and 12, as seen from FIG. 2, have their axes deviated from each other so that the main lens is in non-axis-symmetry at the outside portion. Thus, the side beams corresponding to R (red) and B (blue) arranged at the outside portions pass the portion deviated from the lens central axis toward the center beam in the divergence lens region formed on the $G_4$ electrode 12 side of the main lens region and are subjected to the convergence operation and concentration power toward the central beam direction by the main lens. Thus, the three electron beams are imaged and also converged so as to overlap each other on a shadow mask 4. The operation of converging the electron beams in this way is called static convergence. Each of the electron beams is subjected to color selection by shadow mask 4 and only its component exciting the phosphor of the color corresponding to each beam reaches the phosphor screen 3 through the opening of shadow mask. Further, on outer magnetic deflection yoke 14 is provided to scan the electron beams on the phosphor screen 3.

The causes that greatly influence the focus characteristic of the color picture tube mentioned above are a lens magnifying power of the main lens and an aberration thereof which are dependent upon the lens convergence operation. Generally, weakening the lens convergence operation of the main lens decreases the lens magnifying power and the spherical aberration, thereby improving the focus characteristic. One of the methods of weakening the lens convergence operation is to enlarge the apertures of $G_3$ and $G_4$ electrodes that constitute the main lens.

However, in the in-line type electron gun as shown in FIG. 1, the main lenses corresponding to three colors of R, G and B are arranged on the same horizontal plane so that the diameter of the above apertures must be $\frac{1}{3}$ or less of that of the neck tube incorporating the electron guns in glass envelope 1. Further considering the problem on electrode manufacturing, the allowable critical value thereof will be smaller.

The inventors of this invention proposed a method for effectively increasing the above critical value of the apertures in JP-A-59-21564. The method disclosed therein is to increase the effective aperture diameter of the lens of converging the outer portion of side beams as large as possible, thereby removing halo in the side beams to improve the resolution of the color picture tube.

FIG. 3 shows a perspective view, partially broken, of the electrode structure of the main lens portion disclosed in the above JP-A-59-215640 and FIG. 4 is a front view of the $G_4$ electrode 12 side viewed from the $G_3$ electrode 11 side in the direction of line IV—IV. As shown in FIG. 3, inner electrodes 112 and 122, which constitute the facing plane of $G_3$ electrode 11 and $G_4$ electrode 12, are retreated therefrom by $m_1$ and $m_2$, respectively. Thus, the inner electrodes invade deep in the $G_3$ and $G_4$ electrodes, thereby providing the same effect as the increase of the aperture part thickness. Namely, the effective thickness of the main lens will be increased. The electrode structure shown in FIG. 3 is assembled, for example, by inserting the components into a mandrel or the like so that the center axis of elliptical apertures 123 and 124 of inner electrode 122 coincide with the center axis of the inner diameter of $G_4$ electrode 12, and thereafter fixing them at positions 200 to 203 by laser welding. Incidentally, $A_1$, $A_2$, $A_3$ and $A_4$ denote a central axis, respectively.

From the viewpoint of parts manufacturing, it is desirable to make the outer diameter d of the inner electrode 122 equal to the inner diameter of $G_4$ electrode 12. However, actually, the inner diameter D of $G_4$ electrode 12 can be larger than the outer diameter d of inner electrode 122 ($D > d$). In this case, if $G_4$ electrode 12 is fixed by laser welding or the like, as shown in FIG. 5, $G_4$ electrode 12 will be partially deformed and the end surface 12*a* of $G_4$ electrode 12 will be also deformed. In FIG. 5, $A_4$ and $A_5$ denote the central axis of $G_4$ electrode 12 before and after the deformation. The central axis will be deviated by a. Of course, if the outer diameter d of inner electrode 122 is larger than the inner diameter D of $G_4$ electrode ($d > D$), inner electrode 122 cannot be inserted into $G_4$ electrode 12, thus making the assembling impossible.

The main lens is formed between the end surface 12*a* of $G_4$ electrode 12 and the elliptical apertures of inner electrode 122 and between the end surface of $G_3$ electrode and inner electrode 112. If the main lens is formed in the state where the end surface 12*a* of $G_4$ electrode 12 is deformed, the electric field thus formed will be confused, thereby distorting the main lens. Thus, the beam having passed the main lens will have astigmatism to deteriorate the resolution.

SUMMARY OF THE INVENTION

A main object of this invention is to provide an electron gun for use in a color cathode ray tube that is capable of improving the resolution of the cathode ray tube by assembling, with high accuracy, the centers of the elliptical apertures of inner electrodes and of the inner walls of grid electrodes constituting a main lens.

Another object of this invention is to easily decide the welding positions of cylindrical electrodes that constitute a main lens.

A further object of this invention is to insert the inner electrode into the inside portions of the cylindrical electrodes without producing any deformation of the cylindrical electrodes.

The above objects of this invention can be attained by dividing the grid electrodes serving as a main lens into a plurality of cylindrical electrodes, binding these cylindrical electrodes, and providing inner electrodes at the connecting positions so that the center axes of elliptical apertures of the inner electrodes coincide with the center axes of the inner wall of the main lens electrodes.

Since the grid electrodes are formed in such a structure that the plurality of cylindrical electrodes are bound and the inner electrodes are arranged at the binding positions, the position and size of the inner electrodes can be fixed, and in binding the cylindrical electrodes and the inner electrodes the deformation thereof can be decreased, thereby providing the main lens with no distortion.

BRIEF DESCRIPTION OF THE DRAWINGS

Preferred embodiments of this invention will now be described in conjunction with the accompanying drawings, in which.

DESCRIPTION OF THE PREFERRED EMBODIMENTS

Figure 6:
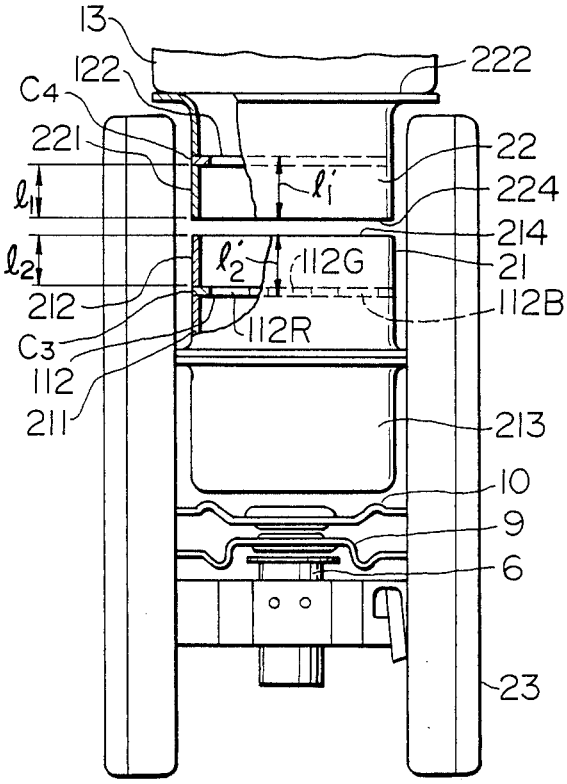
FIG. 6 is a side view, partially broken, of the electron gun according to one embodiment of this invention.

Several embodiments of this invention will be explained in detail with reference to the drawings. FIG. 6 is a sectional view, partially broken, of the electron gun arranged in a longitudinal direction according to one embodiment of this invention.

In FIG. 6, 21 denotes a $G_3$ electrode and 22 denotes a $G_4$ electrode. These electrodes 21 and 22 are constructed as follows. $G_3$ electrode 21 is composed of two cylindrical electrodes 211, 212, an inner electrode 112 and a $G_3$ lower electrode 213, in which inner electrode 112 is sandwiched between cylindrical electrodes 211 and 212 at a binding position $C_3$ thereof. On the other hand, $G_4$ electrode 22 is composed of two cylindrical electrodes 221, 222, and an inner electrode 122, in which inner electrode 122 is sandwiched between cylindrical electrodes 221 and 222 at a binding position thereof. In FIG. 6, $l_1$ and $l_2$ denote the length of cylindrical electrodes 212 and 221, respectively. The length $l_1'$ from an opposite end surface 224 of the $G_4$ electrode 22 to the inner electrode 122 is set to be the same as the length $l_2'$ from an opposite end surface 214 of the $G_3$ electrode 21 to the inner electrode 112. 23 is a bead glass and 24 is a shield cup. The other reference numerals refer to like elements in the foregoing drawings.

Figure 1:
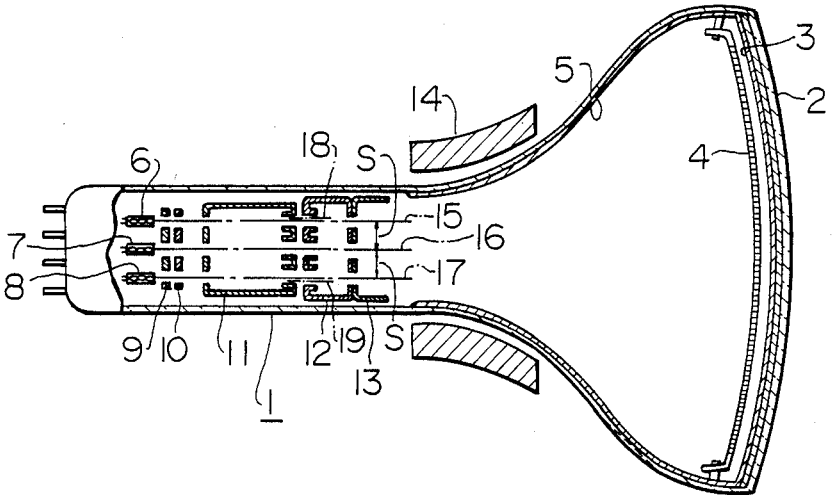
FIG. 1 is a schematic sectional view of the in-line type color picture tube for explaining this invention and the prior art.
Figure 2:
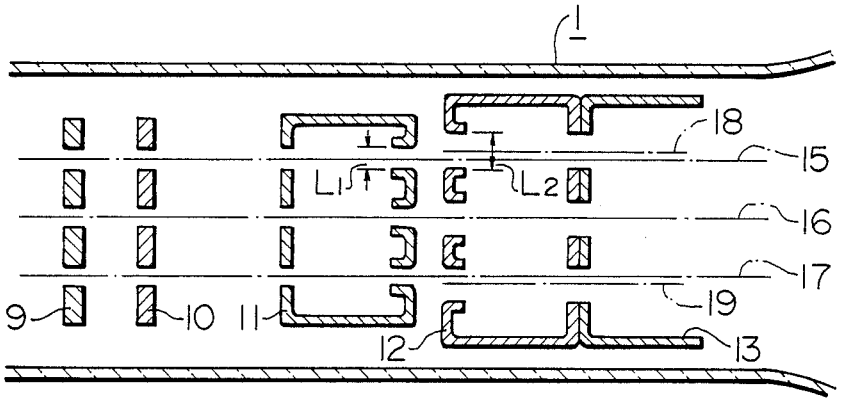
FIG. 2 PRIOR ART
FIG. 2 is an enlarged sectional view of the grid electrode portion in FIG. 1.
Figure 3:
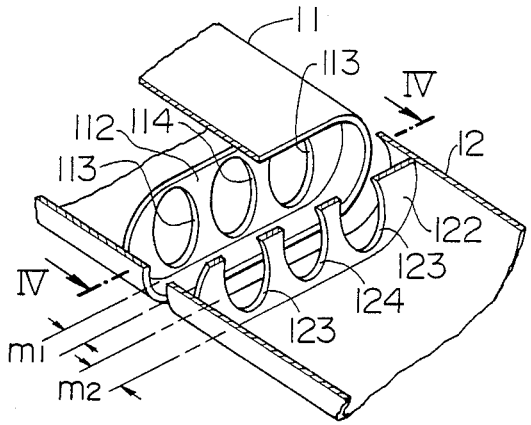
FIG. 3 PRIOR ART
FIG. 3 is a perspective view, partially broken, of one example of a main lens in the prior art electron gun.
Figure 4:
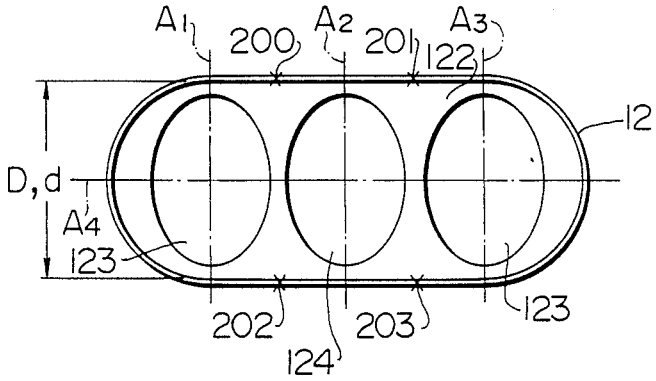
FIG. 4 PRIOR ART
FIG. 4 is a sectional view viewed in the direction IV—IV in FIG. 3.
Figure 5:
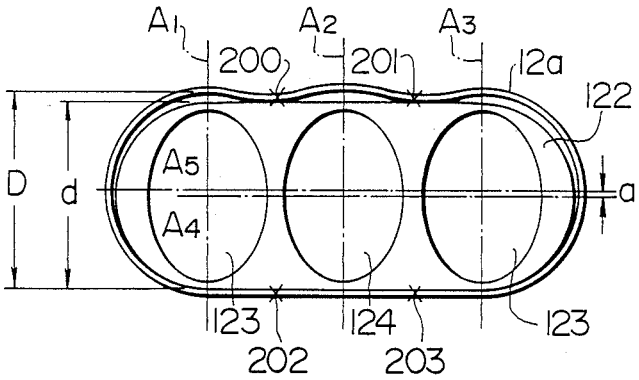
FIG. 5 PRIOR ART
FIG. 5 is a view, corresponding to FIG. 4, for explaining electrode deformation.
Figure 7:
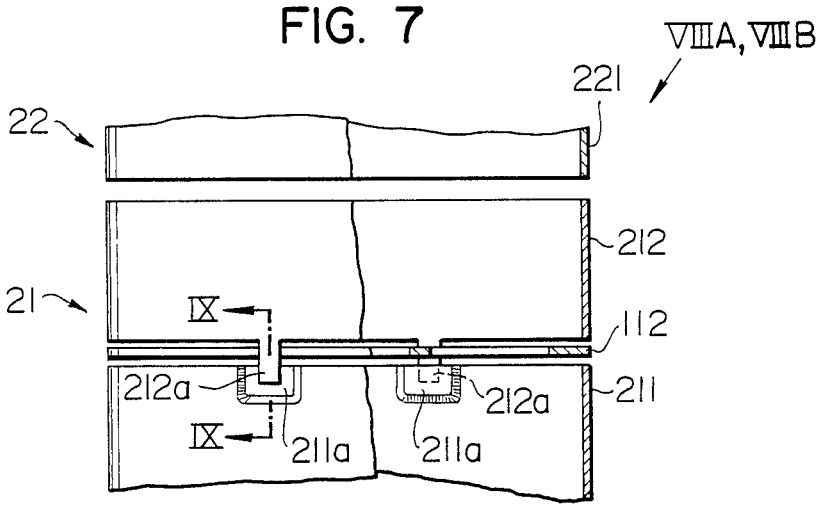
FIG. 7 is an enlarged view of the main part of FIG. 6.

FIG. 7 is an enlarged view, partially broken, of the binding structure of the cylindrical electrodes and the inner electrode. These three components are bound as follows. Cylindrical electrode 212 is provided with four tongues 212*a* located at the positions corresponding to the welding points 200 to 203 in FIG. 4. These tongues 212*a* are extended over inner electrode 112 toward the other cylindrical electrode 211. Cylindrical electrode 211 is provided with four recesses 211*a*. Cylindrical electrodes 211 and 212 are bonded by welding the tongues 212*a* to the recesses 211*a*. Inner electrode 112 is also bonded to cylindrical electrode 212 at the tongue positions.

Figure 8A:
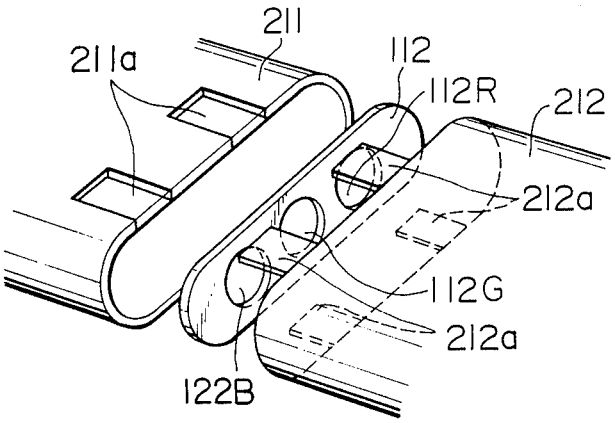
FIGS. 8A and 8B are perspective views, partially broken, of FIG. 7.
Figure 8B:
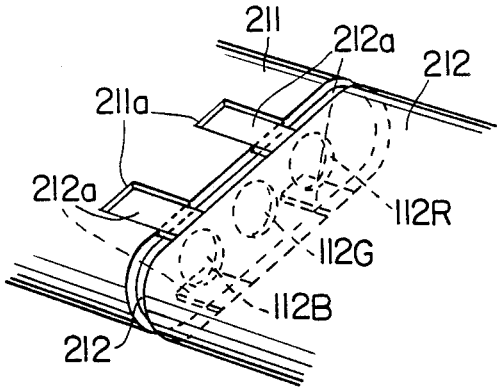
Figure 9:
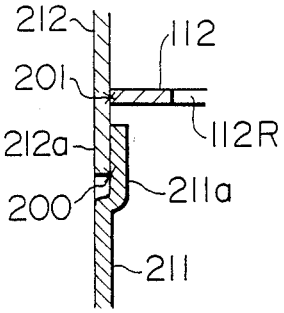
FIGS. 9 to 15 are sectional views showing several examples of the main part of the structure of binding cylindrical electrodes and inner electrodes in accordance with this invention.

FIGS. 8A and 8B are perspective views, partially broken, of the inner electrode and cylindrical electrodes shown in FIG. 7 viewed from the directions VIIIA, VIIIB, particularly, FIG. 8A shows an exploded view and FIG. 8B shows an assembled view and FIG. 9 is a sectional view taken on line IX—IX of FIG. 7.

This structure can be formed by using a mandrel so that cylindrical electrodes 211 and 212 form a common plane and the centers of three elliptical apertures 112R, 112G and 112B and of the inner walls of cylindrical electrodes 211 and 212 coincide with other. Therefore, even if the outer diameter of inner electrode 112 is smaller than the inner diameter of cylindrical electrodes 211 and 212, these components can be welded without any deformation of the inner diameter of the inner electrode by deforming the tongues 212*a*. Thus, cylindrical electrodes 211 and 212 and inner electrode 112 surely coincide with each other in their center, thus permitting astigmatism of the main lens to be removed.

Figure 10:
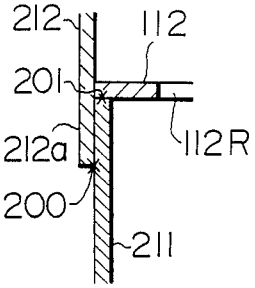
Figure 11:
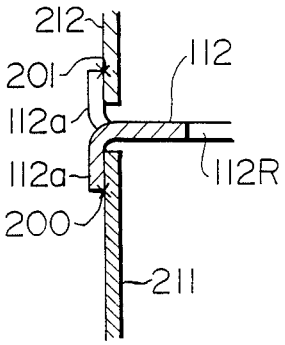
Figure 12:
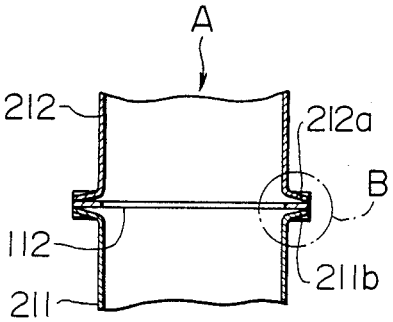
Figure 13:
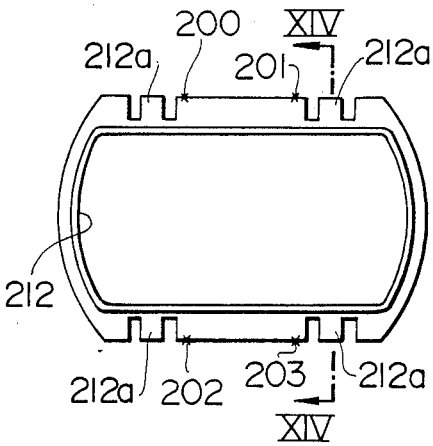
Figure 14:
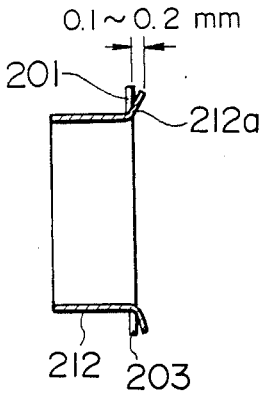
Figure 15:
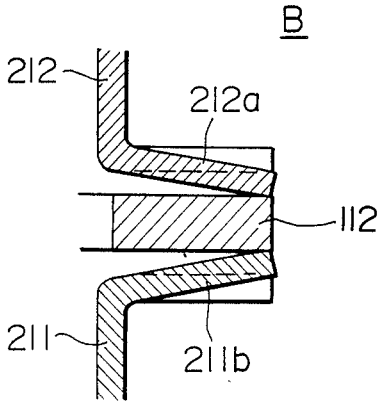

FIGS. 10 to 15 show the bonding structure, corresponding to FIG. 9, of the cylindrical electrodes and inner electrode according to another embodiment of this invention. In FIG. 10, the inner diameter of one cylindrical electrode 212 is made larger than the other cylindrical electrode 211 and their part are overlapped. In this structure of FIG. 10, it is not necessary to provide recesses in the other cylindrical electrode 211. In FIG. 11, inner electrode 112 (but not cylindrical electrode) is provided with two tongues 112*a*. In the structure of FIG. 11, any particular working for bonding is not required for both cylindrical electrodes 211 and 212. In the embodiment of FIG. 12, cylindrical electrodes 211 and 212 are provided with tongues 211*a* and 211*b* outwardly extended. Cylindrical electrodes 211, 212 and inner electrode 112 are laser-welded in such a state that cylindrical electrodes 211 and 212 are pressed inwardly in the vertical direction so as to maintain component parallelism. Thus, the tongues 211*a* and 211*b* of cylindrical electrode 211 and 212 are formed so as to be in parallel to inner electrode 112. FIG. 13 shows a view of cylindrical electrode 212 viewed from A part in FIG. 12. In FIG. 13, 200 to 203 denote welding points with inner electrode 112. FIG. 14 is a sectional view taken on line XIV—XIV of FIG. 13. The gap between the welding point and tongue 212*a* before pressing is preferably 0.1 mm to 0.2 mm, which has been experimentally confirmed. FIG. 15 is an enlarged view of B portion of FIG. 12.

As understood from the above description, several arrangements to bond or engage cylindrical electrodes 211, 212 and inner electrode 112 can be proposed.

In all the embodiments mentioned above, two cylindrical electrodes and an inner electrode are combined for both $G_3$ electrode and $G_4$ electrode but this invention is not limited to this arrangement. Although both $G_3$ and $G_4$ electrode are formed in the combination structure of the cylindrical electrode and inner electrode, this structure may be adopted for either one of $G_3$ and $G_4$. Although four grids are used in the electron gun mentioned above, more or less than four grids may be used. The inner electrode may have circular (but not elliptical) electron beam passing apertures and further semi-circular side beam passing apertures with their outside portion cut away.

In accordance with this invention, astigmatism occurring at random in the main lens can be removed, thereby greatly improving the focus characteristic of a color cathode ray tube.

The bonding of cylindrical electrodes and an inner electrode can be easily automated by a robot operation.

The welding can be easily performed without any need of providing holes for deciding the welding position of the cylindrical electrodes.

Further, the inner electrode can be inserted, with high accuracy into the inside portions of the cylindrical electrodes without any fear of deformation of the cylindrical electrodes.

We claim

1. An electron gun, wherein the at least one of the plurality of grid electrodes serves as a main lens of the electron gun and a center of an elliptical aperture of the at least one inner electrode coincides with a center of an inner all of at least one of the cylindrical electrodes of the at least one of the plurality of grid electrodes, and an outer surface of the at least one inner electrode is tightly engaged with an inner surface of the inner wall of the at least one of the cylindrical electrodes, thereby enabling removal of astigmatism in the main lens and improving resolution of the color cathode ray tube, wherein the at least one of the plurality of grid electrodes serves as a main lens of the electron gun and a center of an elliptical aperture of the at least one inner electrode coincides with a center of an inner wall of at least one of the cylindrical electrodes of the at least one of the plurality of grid electrodes, and an outer surface of the at least one inner electrode is tightly engaged with an inner surface of the inner wall of the at least one of the cylindrical electrodes, thereby enabling removal of astigmatism in the main lens and improving resolution of the color cathode ray tube.

2. An electron gun for use in a color cathode ray tube comprising a plurality of grid electrodes, and a plurality of cathodes arranged in parallel, at least one of the plurality of grid electrodes including a plurality of cylindrical electrodes coaxially connected and at least one inner electrode disposed proximate to at least one connection portion of two of the coaxially connected cylindrical electrodes of the at least one of the plurality of grid electrodes, wherein the plurality of cylindrical electrodes of the at least one of the plurality of grid electrodes are connected to one another by a welded tongue provided on one of the cylindrical electrodes and welded to another of the cylindrical electrodes so that the one and the another cylindrical electrodes provide a common plane.

3. An electron gun for use in a color cathode ray tube comprising a plurality of grid electrodes, and a plurality of cathodes arranged in parallel, at least one of the plurality of grid electrodes including a plurality of cylindrical electrodes coaxially connected and at least one inner electrode disposed proximate to at least one connection portion of two of the coaxially connected cylindrical electrodes of the at least one of the plurality of grid electrodes, wherein the plurality of cylindrical electrodes of the at least one of the plurality of grid electrodes have portions at least partially overlapping one another in the axial direction of the electron gun.

4. An electron gun, wherein the at least one of the plurality of grid electrodes serves as a main lens of the electron gun and a center of an elliptical aperture of the at least one inner electrode coincides with a center of an inner all of at least one of the cylindrical electrodes of the at least one of the plurality of grid electrodes, and an outer surface of the at least one inner electrode is tightly engaged with an inner surface of the inner wall of the at least one of the cylindrical electrodes, thereby enabling removal of astigmatism in the main lens and improving resolution of the color cathode ray tube, wherein the at least one inner electrode includes a substantially flat plate member having a plurality of apertures therein, the substantially flat plate member being disposed at the at least one connection portion.

5. An electron gun according to claim 4, where at least one of the plurality of apertures of the substantially flat plate member is at least partially elliptical.

* * * * *